US010767370B2

(12) United States Patent
Reyburn et al.

(10) Patent No.: US 10,767,370 B2
(45) Date of Patent: Sep. 8, 2020

(54) VENTILATED SKYLIGHT

(71) Applicant: Suncast Technologies, LLC, Palm Beach Gardens, FL (US)

(72) Inventors: Justin Charles Reyburn, Batavia, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 167 days.

(21) Appl. No.: 15/815,359

(22) Filed: Nov. 16, 2017

(65) Prior Publication Data

US 2019/0145105 A1 May 16, 2019

(51) Int. Cl.
*E04D 13/03* (2006.01)
*F24F 7/02* (2006.01)

(52) U.S. Cl.
CPC ..... *E04D 13/0325* (2013.01); *F24F 7/02* (2013.01); *E04D 13/0305* (2013.01); *F24F 2221/20* (2013.01)

(58) Field of Classification Search
CPC ..... E04D 13/0325; F24F 7/02
See application file for complete search history.

(56) References Cited

U.S. PATENT DOCUMENTS 3,085,490 A * 4/1963 Field ..... E04D 13/0325 454/199
D277,026 S 1/1985 Waltz et al.
D277,027 S 1/1985 Waltz et al.
4,683,687 A * 8/1987 Crider ..... E04B 7/16 454/199
4,730,552 A 3/1988 Murray
5,374,215 A 12/1994 Crider et al.
5,435,780 A 7/1995 Ayles
5,561,952 A 10/1996 Damron
6,102,794 A 8/2000 Cline
D431,291 S 9/2000 McKee
6,155,008 A 12/2000 McKee
6,302,787 B1 10/2001 Graft, Jr.
6,520,852 B2 2/2003 McKee et al.
6,612,924 B1 9/2003 Mantyla et al.
6,767,281 B2 7/2004 McKee
6,802,158 B1 * 10/2004 Greene ..... E04H 1/1205 52/270
6,821,049 B1 * 11/2004 Greene ..... E04H 1/1205 403/348

(Continued)

FOREIGN PATENT DOCUMENTS

CA 2309941 7/2009

*Primary Examiner* — Avinash A Savani
*Assistant Examiner* — Martha M Becton
(74) *Attorney, Agent, or Firm* — McHale & Slavin, P.A.

(57) ABSTRACT

A ventilated skylight for a shed enclosure. The ventilated skylight formed from a base member securable to the roof of a residential shed. The base member has a flange for receipt of a gasket for securement directly to the shed roof. Upright walls of the base member include a plurality of slots constructed and arranged to allow air to circulate through the shed. A cap member is securable to the base member with side walls to prevent rain water from entering the vertical slots. In a preferred embodiment, the cap member is made of a translucent material to allow light to illuminate the inside of the shed enclosure.

4 Claims, 5 Drawing Sheets

(56) References Cited

U.S. PATENT DOCUMENTS

| | | | | |
|---|---|---|---|---|
| D556,314 | S | 11/2007 | Daniels, II et al. | |
| 7,721,493 | B2 * | 5/2010 | Skov | E04D 13/03 52/200 |
| 8,938,921 | B2 * | 1/2015 | Hartman | E04C 2/525 52/200 |
| 9,151,068 | B2 | 10/2015 | Vogler et al. | |
| 2015/0321131 | A1 | 11/2015 | Bourque et al. | |

* cited by examiner

VENTILATED SKYLIGHT

FIELD OF THE INVENTION

This invention relates to the field of venting devices, and in particular, to a passive ventilated skylight for a shed enclosure.

BACKGROUND OF THE INVENTION

Ventilation is necessary for most any enclosed structure. Enclosed structures known as residential sheds have a particular need for venting, as they are designed for outdoor placement and, thus, subjected to the elements throughout the year. A residential shed used for storage may not be opened for weeks or even months. Sheds are not designed for receipt of electrical power, so the use of powered fans, dehumidifiers, or air conditioners is not possible.

A sealed enclosure can cause numerous problems, the most noticeable being an excess amount of moisture buildup within the shed, which can accelerate rusting of metal based devices. For instance, a shed can be used to store lawnmowers tractors, bicycles, and so forth. Lack of proper ventilation could cause premature aging of such products, especially internal combustion engines where cylinders can rust. To prevent a tightly sealed enclosure which can result in excess internal condensation taking place, shed manufacturers include spacing within walls, seams, or doors to assure proper ventilation. A problem with simply using spacing to allow ventilation is that, during rain, water can easily enter the shed through the spacing.

In addition to the need for ventilation in a shed, there is also a need for light. A clear piece of plastic can be placed in a roof of a shed, but that does not provide ventilation and may be another source for water leaks.

Passive vents do not include a mechanism for forcing air out of the enclosure. Rather, they simply include a vent structure in the form of an air conduit which allows air flow. Passive vents are well-known and have been extensively used in the past.

U.S. Pat. No. 9,151,068 discloses a shed having a roof panel with an aperture sized to receive a skylight. The skylight compresses a seal to prevent water passage, and a secondary rib on a roof panel prevents water from passing through the skylight aperture.

U.S. Pat. No. 6,155,008 discloses a passive venting device for venting a building enclosure. The device has a base member having an outer flange for securing the base member to a surface, and a vent structure within the base member for permitting gases and vapors to pass through the base member. The venting device employs a vent structure, including a filter screen, to prevent objects from passing through the base member. A cap member is immovably mounted to the base member and spaced therefrom sufficiently to permit the free flow of air between the cap member and the base member and through the vent structure.

U.S. Pat. No. 5,561,952 teaches a static roof vent comprising a base/flange containing an air conduit and a hood. The hood includes a translucent oriel located above the air conduit. However, this device is difficult and expensive to manufacture, in that the central oriel is made from an expensive clear material that must be inserted into specially designed opaque mounts, which in turn are attached to the roof.

U.S. Pat. No. 5,435,780 discloses a ventilated skylight having a light transmissive dome. The dome is supported by a support ring, which is initially provided in two halves and must be welded together for use. The support ring is then installed on a soaker tray, which is in turn attached to the roof. Separate ventilation tabs ale inserted into the underside of the light transmissible dome to provide ventilation.

U.S. Pat. No. 4,730,552 discloses a ventilating skylight. The device includes a housing having an opaque top wall. The housing includes front and rear openings through which sunlight may pass when the door to those openings are open. There is further a transparent dividing wall below the openings and parallel to the top wall. The transparent dividing wall has an air flow passage at its center.

SUMMARY OF THE INVENTION

Disclosed is a ventilated skylight having a base member securable to the roof of a shed enclosure. The base member has an integrated flange for receipt of a gasket that is fastened to the shed roof using fastening screws; no additional flange is required inside the shed. Upright walls of the base member include a plurality of slots constructed and arranged to allow air to circulate throughout the shed. A cap member is securable to the base member with side walls to prevent rain water from entering vertical slots used for venting. The cap member is made of a translucent material so as to allow light to illuminate the inside of the shed enclosure.

An objective of the invention is to provide ventilated skylight that allows sunlight to pass through the cap member for illumination of the shed, as well as allow air to circulate in the shed.

Another objective of the invention is to provide an opening in the roof of a shed to allow excess heat to escape.

Another objective of the invention is to reduce the humidity within a shed enclosure by providing adequate ventilation throughout temperature changes.

Still another objective of the invention is to provide a low cost venting device that eliminates the need for placement of a flange on the inside of the roof by use of a single flange placed on the outside of the roof.

Another objective of the invention is to provide a venting device that needs only fasteners to be attached from the inside of the shed, allowing an inner surface that is free of protrusions.

Still another objective of the invention is to provide a venting device that is sealed with a gasket only from the outside of the shed enclosure.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

Figure 1:
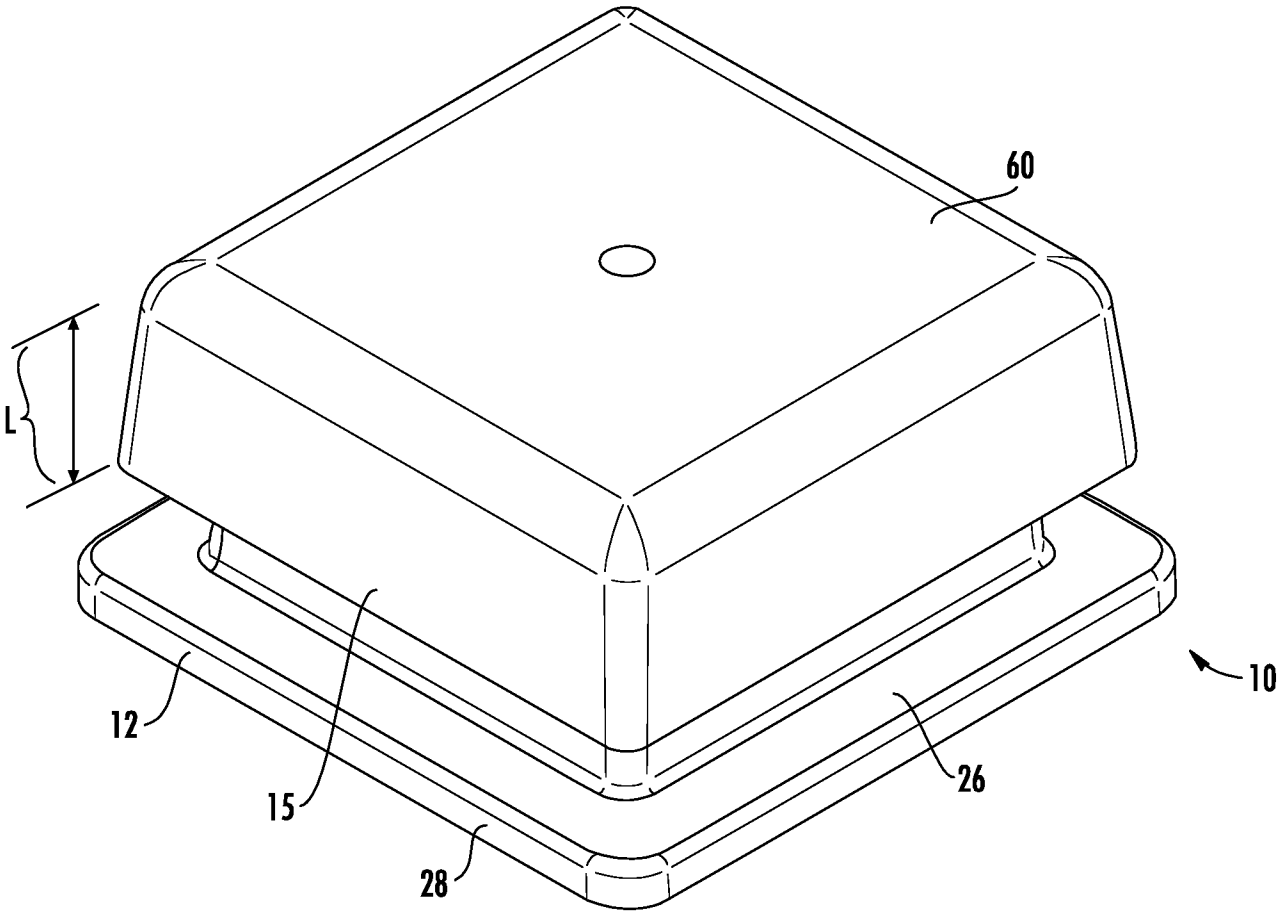
FIG. 1 is a perspective view of the ventilated skylight.
Figure 2:
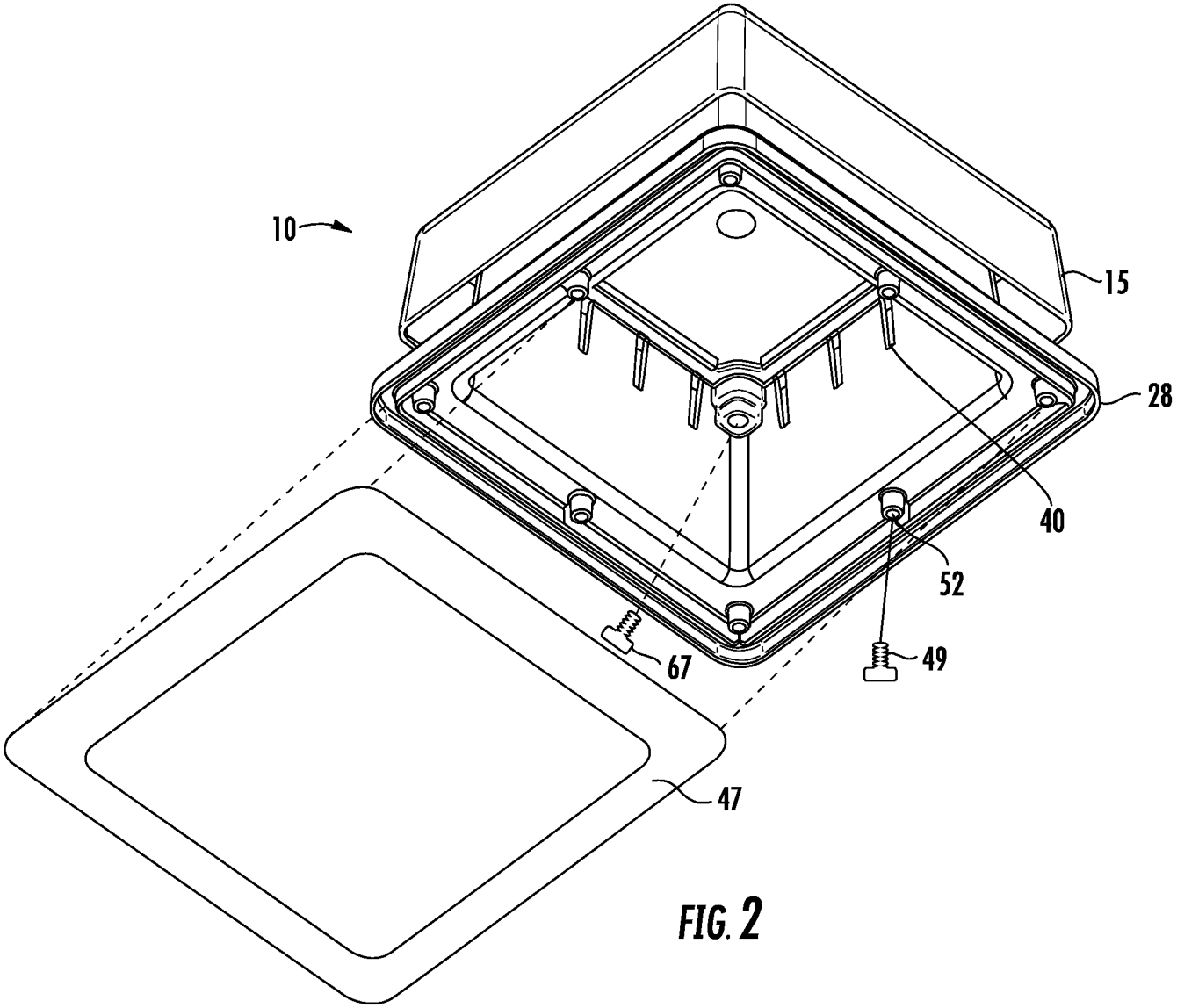
FIG. 2 is a bottom perspective view thereof.

Now referring to the figures in general, set forth is a ventilated skylight 10 having a base member 12 and a cap member 15. The base member 12 is formed by four upright sidewalls and a flange. a first upright wall 14 adjoining a second upright wall 16, adjoining a third upright wall 18, which adjoins a fourth upright wall 20. The base member is formed from a single piece of injection molded plastic to form a substantially square enclosure. Upright wall 14 is further defined by a top edge 22 which is continuous around the top of the four upright walls, as well as a bottom edge 24 which terminates on the upper surface 26 of flange 28. Each of the upright walls 14, 16, 18 and 20, terminate in a corner as they adjoin the next wall. Using upright wall 14 for illustration, corner 30 is formed as the wall adjoins upright wall 16. Near the top edge 22 of corner 30, a receptacle 32 is indented from the top edge 22, providing an alignment wall 34 which surrounds a fastener aperture 36. To minimize confusion, a single corner 30 and upright wall 14 only will be detailed in this specification, as each corner and upright wall forms a mirror image of an adjoining wall.

Figure 3:
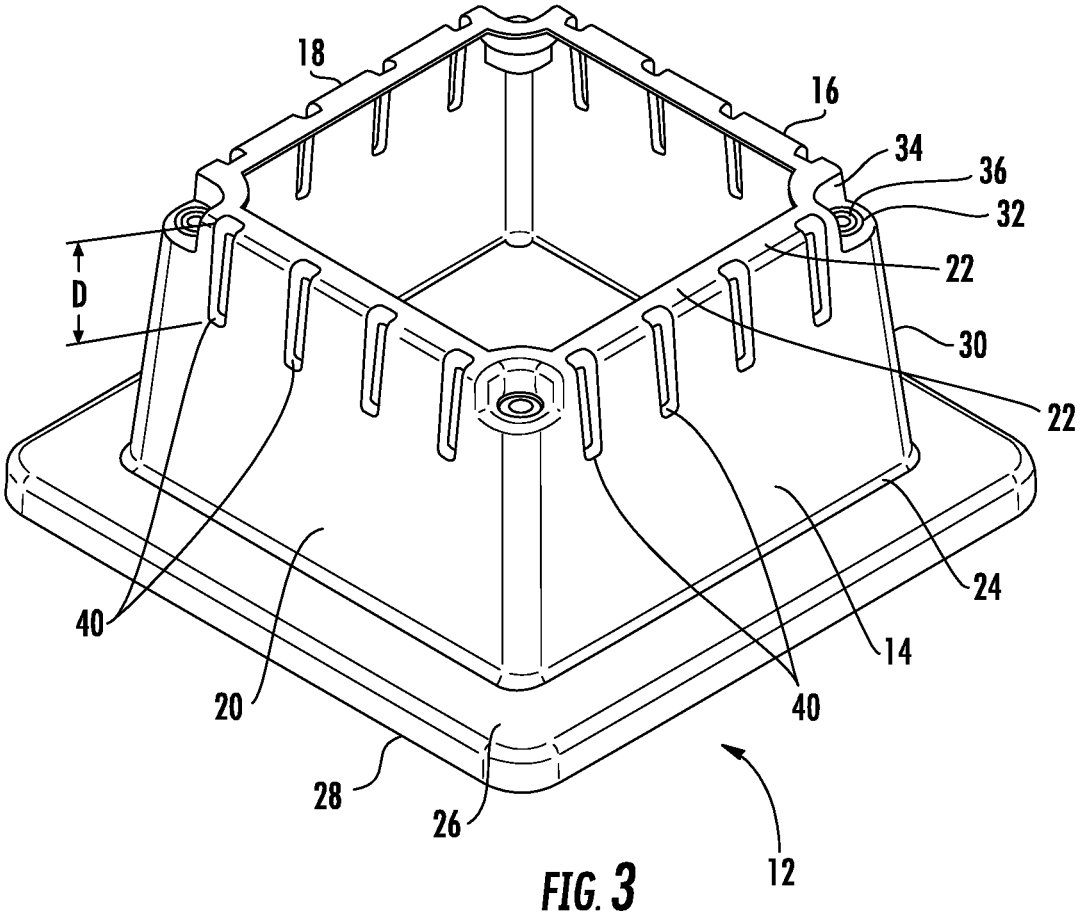
FIG. 3 is a perspective view of the base member for the ventilated skylight.
Figure 4:
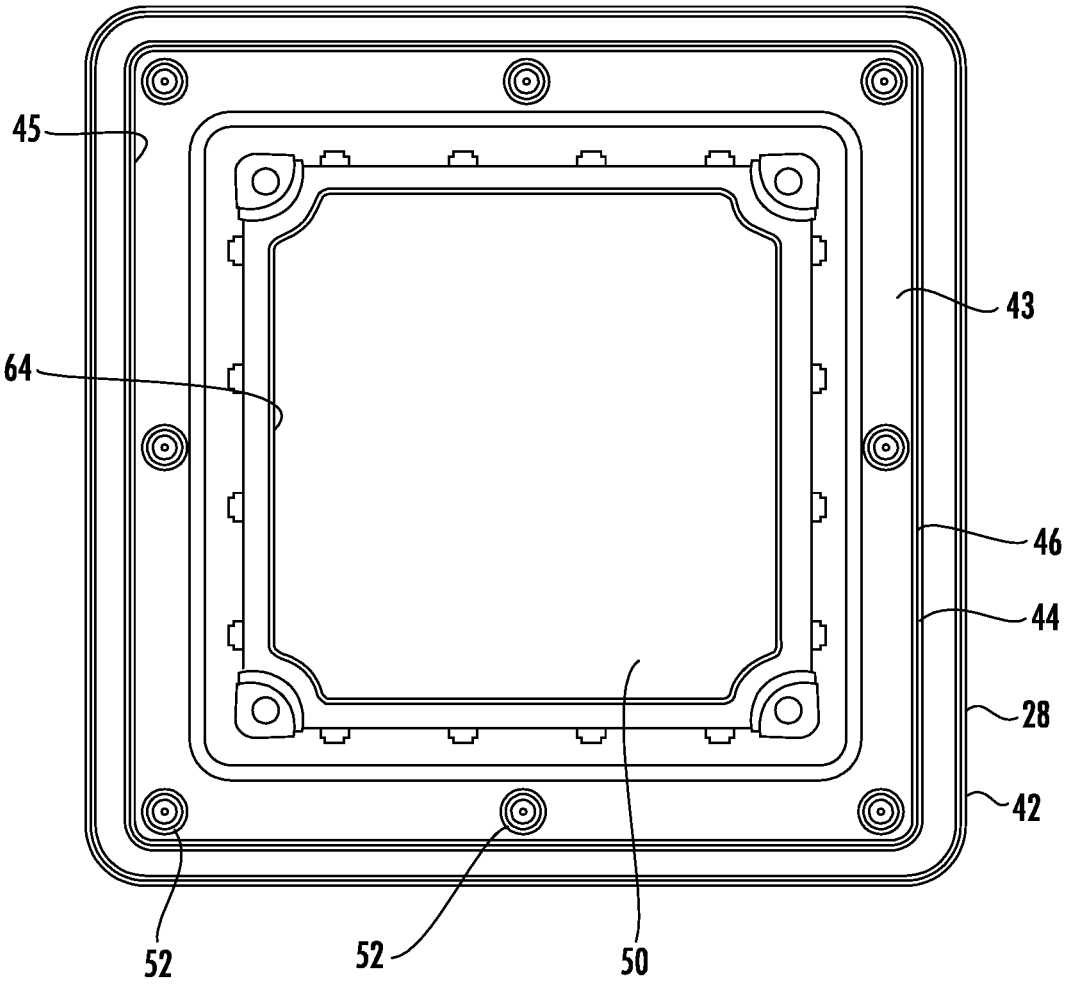
FIG. 4 is a bottom view of the base member.
Figure 5:
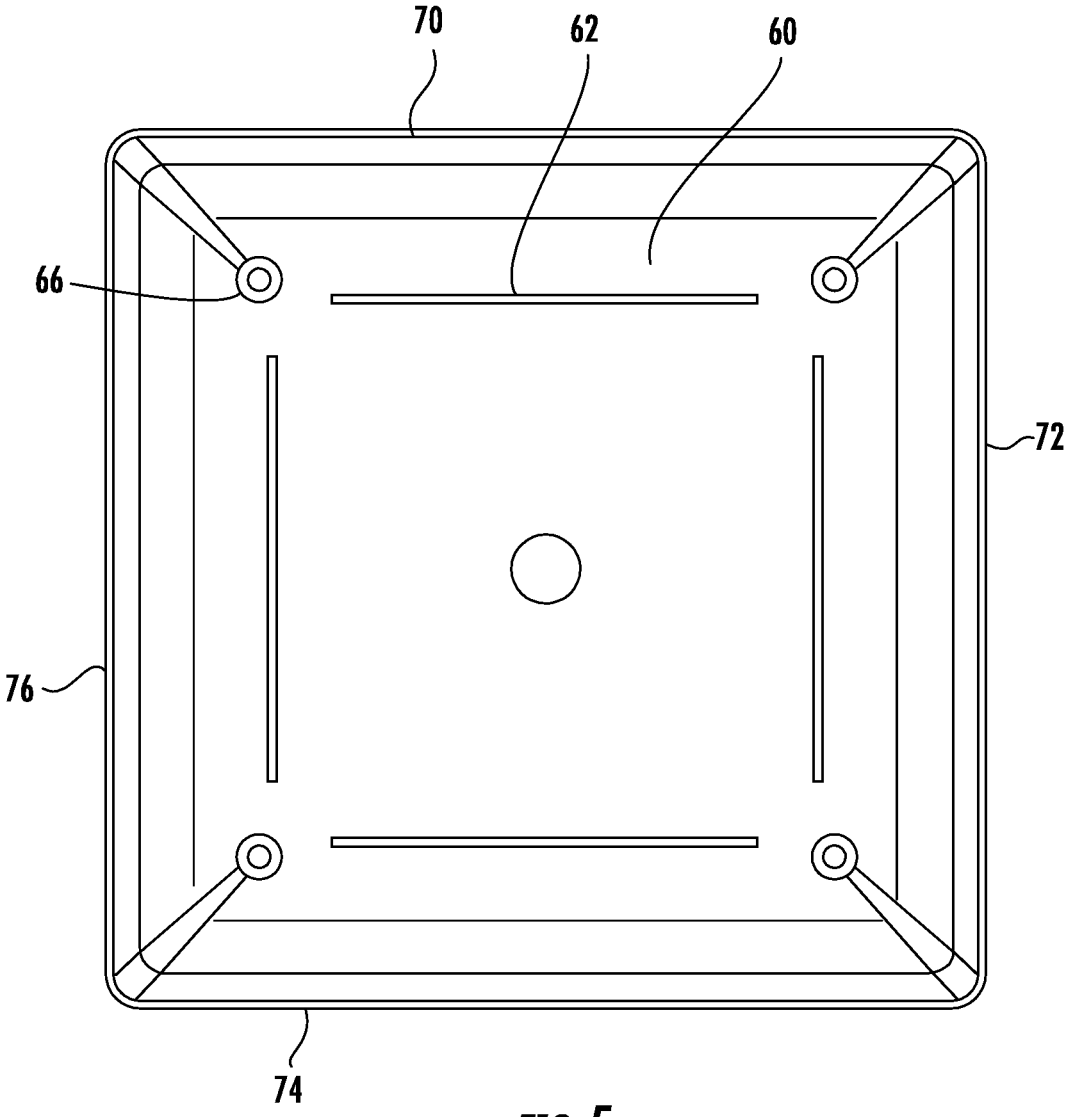
FIG. 5 is a bottom view of the cap member for the ventilated skylight.

The upper edge of the side wall 22 includes a plurality of vertical slots 40. In the preferred embodiment, there are four vertical slots, as illustrated in FIG. 3. Each vertical slot 40 extends a distance from the top edge 22, forming an inhibited passageway. However, the width of the passageway is sized to prevent larger insects, such as flies and wasps, from passing through. The distance of each vertical slot extending from the top edge 22 need only be about one inch in length, as each upright wall may have multiple vertical slots, like the four vertical slots 40 depicted on each upright wall.

The base member flange 28 includes a continuous outer wall 42 depending from a lower surface 43 of the flange 28. The outer wall 42 is spaced apart from a continuous inner wall 44, forming a U-shaped receptacle 46 therebetween. The receptacle 46 receives a gasket 47, for use in sealing the base member 12 to a roof of a shed (not shown). A central opening 50 in the middle of the base member would approximate the size of the opening in the roof of the shed. Threaded tabs 52 are located along an inner perimeter 45 of the inner wall 44 for receipt of a fastener 49 placed through the roof. Engaging a faster, not shown, with each threaded tab 52 secures the flange 28 of the base member 12 against the roof of the shed. The threaded tabs 52 are placed inside the inner wall 44 so as to provide protection of the fasteners from the elements, the gasket 47 being placed on the outer side of the threaded tabs.

In a preferred embodiment, a threaded tab 52 is placed at each corner of the base member 12, as well as between along the width of each upright wall 14, 16, 18, 20, providing eight fasteners to hold the base member to the shed. The placement of the threaded tabs 52 provides proper compression of a gasket 47 placed within receptacle 46 to prevent leakage.

The cap member 15 is defined by a top wall 60 sized to cover the opening 50. Raised ridges 62 are placed on the inner surface of top wall 60 and arranged to fit along an inner surface 64 of the top edge 22 of the upright walls. In addition, the cap member 15 includes threaded bosses 66, which are constructed and arranged to fit the alignment wall 34 of the receptacle 32. The bosses 66 combined with the raised ridges 62 securely align the cap member 15 to the base member 12 and eliminates the need for sealing. A fastener 67 is inserted into each threaded boss 66, securing the base member 12 to the cap member 15.

The cap member 15 includes side walls 70, 72, 74 and 76; each side having a length "L" so as to extend over the distance "D" of the vertical slots 40. As depicted, each wall has four vertical slots 40, which has been found sufficient to allow proper ventilation of the shed, both in allowing heat to escape, as well as preventing moisture from accruing within the shed in high humidity instances. In a preferred embodiment, the cap member 15 is made of a one-piece translucent plastic; the translucent material allowing sunlight to pass through the opening 50 so as to illuminate the inside of the shed with available sunlight.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described is connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The invention claimed is:

1. A ventilated skylight for a flat plastic shed enclosure comprising:

a base member having four upright walls defining a top edge, a bottom edge and a side edge, each upright wall side edge forming a corner providing a square shaped structure, a top edge of each corner forming a receptacle indented from said top edge, providing an alignment wall which surrounds a fastener aperture, said bottom edge of each upright wall terminating with an upper wall of a flange, said flange having a flat surface with a continuous outer wall depending from said upper wall spaced apart from a continuous inner wall forming a receptacle, a plurality of threaded tabs are formed along said inner wall of said flange for receipt of fasteners accessible only from said inner wall with said fasteners used to secure said flange to cover an opening in said shed enclosure, a plurality of vertical slots formed in each said upright wall forming a passageway having a length extending from said top edge;

a gasket constructed and arranged for placement in said receptacle, a portion of said gasket compressed against the outer surface of a plastic roof by said continuous inner wall when said fasteners secured said base to the plastic roof;

a cap member having a square shaped top wall sized to cover said top edge of said upright walls, sidewalls depending from said cap member extend a distance that exceeds the length of said vertical slots, corners formed by said cap member sidewalls include a threaded boss constructed and arranged to fit within said base member indented receptacle; and a fastener insertable through each fastener aperture for securing to each said threaded boss;

wherein said threaded boss aligns said cap member to said base member and is secured thereto by fasteners;

wherein said base member is secured to the flat outer surface of a plastic roof using fasteners inserted through the inner surface of said plastic roof from the inside of the shed, said fasteners directed through said gasket and engaging said threaded tabs, said continuous inner wall sealing said base member to said outer surface of said plastic roof whereby said fasteners are accessible only from said inner surface of said plastic roof; whereby each said passageway having a width sized to prevent large insects from passing through while allowing air to pass through.

2. The venting device for a shed enclosure according to claim 1 wherein said cap member is made from a translucent material.

3. The venting device for a shed enclosure according to claim 1 wherein said flange member is formed of plastic and is integral to said base member.

4. The venting device for a shed enclosure according to claim 1 wherein said fasteners are concealed from external view.

* * * * *